US008245380B2

(12) United States Patent
Ramamurthy et al.

(10) Patent No.: US 8,245,380 B2
(45) Date of Patent: Aug. 21, 2012

(54) METHOD FOR UNDERMOUNTING A SINK

(75) Inventors: Rajesh Ramamurthy, Temple, TX (US); Herman Lee Ratliff, Lott, TX (US); Richard Anthony Conde, Troy, TX (US); Robert W. Moore, Temple, TX (US); Robert Guerra, Temple, TX (US); Jacinto Moreno, III, Temple, TX (US)

(73) Assignee: Premark RWP Holdings, Inc., Wilmington, DE (US)

( * ) Notice: Subject to any disclaimer, the term of this patent is extended or adjusted under 35 U.S.C. 154(b) by 952 days.

(21) Appl. No.: 12/269,265

(22) Filed: Nov. 12, 2008

(65) Prior Publication Data

US 2009/0139076 A1 Jun. 4, 2009

Related U.S. Application Data

(60) Provisional application No. 60/996,357, filed on Nov. 13, 2007.

(51) Int. Cl.
*B21D 39/00* (2006.01)
*B23P 25/00* (2006.01)
*E03C 1/33* (2006.01)

(52) U.S. Cl. ..... 29/458; 4/632

(58) Field of Classification Search ..... 29/458, 29/527.1, 527.2, 557, 558; 4/630, 632, 635
See application file for complete search history.

(56) References Cited

U.S. PATENT DOCUMENTS

| | | | | |
|---|---|---|---|---|
| 6,108,831 | A * | 8/2000 | Lombreglia, Jr. | 4/631 |
| 6,691,341 | B2 * | 2/2004 | Loch | 4/632 |
| 6,978,529 | B1 * | 12/2005 | Pearse | 29/402.08 |
| 7,007,317 | B1 | 3/2006 | Brown | |
| 2009/0144893 | A1 * | 6/2009 | Cusimano | 4/643 |

FOREIGN PATENT DOCUMENTS

| | | |
|---|---|---|
| DE | 8032020 | 7/1981 |
| DE | 102006056786 | 6/2008 |
| EP | 0814209 | 12/1997 |

OTHER PUBLICATIONS

"Installation Guide", KARRAN, www.karran.com, 16 pgs.

* cited by examiner

*Primary Examiner* — Jermie Cozart
(74) *Attorney, Agent, or Firm* — Welsh Flaxman & Gitler LLC

(57) ABSTRACT

A method for undermounting a sink to a countertop includes preparing a countertop and a sink. Thereafter a primary channel is routed within the backside of the countertop, the primary channel including a base and being shaped and dimensioned for receipt of the sink flange, and a secondary channel is routed within the base of the primary channel along an interior circumference of the primary channel. Substrate material is then removed from the secondary channel to expose an underside of the decorative laminate and adhesive is applied within the secondary channel so that the underside of the decorative laminate is fully covered. A bead of adhesive is applied to the base of the primary channel and the sink flange is placed within the primary channel. A support plate is secured around the sink flange to provide support and a central portion of the countertop defined by the primary channel is cut out to expose the bowl of the sink.

18 Claims, 9 Drawing Sheets

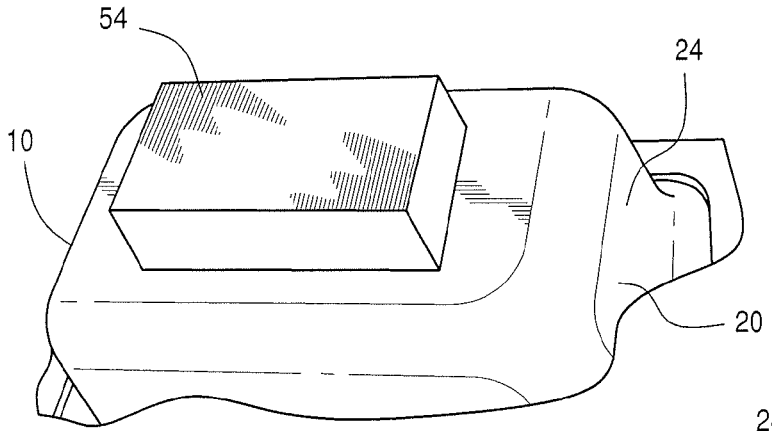
FIG. 16
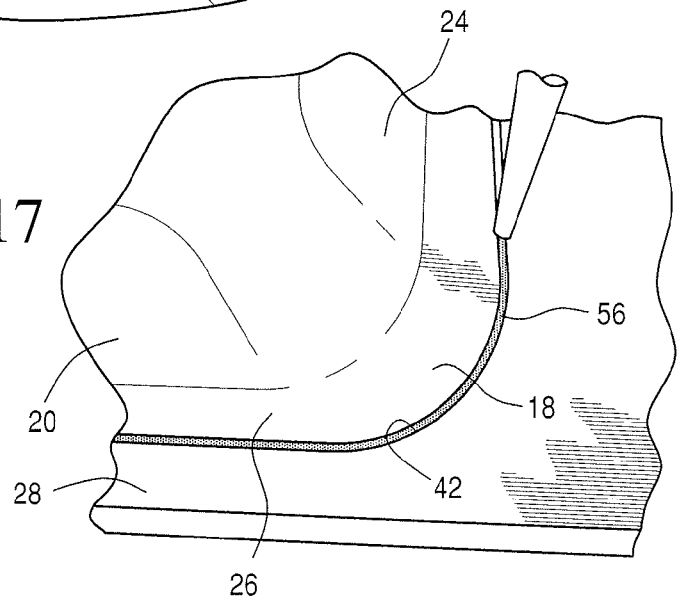
FIG. 17
FIG. 18
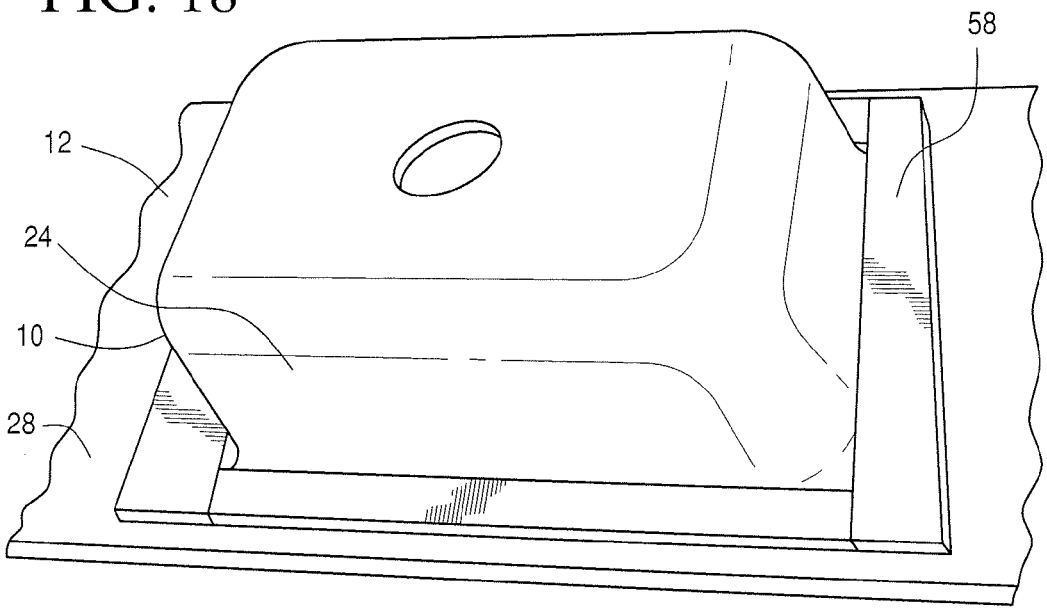

METHOD FOR UNDERMOUNTING A SINK

CROSS REFERENCE TO RELATED APPLICATION

This application claims the benefit of U.S. Provisional Patent Application Ser. No. 60/996,357, entitled "METHOD FOR UNDERMOUNTING A SINK", filed Nov. 13, 2007.

BACKGROUND OF THE INVENTION

1. Field of the Invention

The invention relates to a method for undermounting a sink. More particular, the present invention relates to a method for undermounting a sink to a decorative laminate countertop, as well as the undermounted sink and countertop combination.

2. Description of the Related Art

It is often desirable to mount a sink beneath a decorative laminate countertop. This provides for an aesthetically desirable appearance and inherently prevents the accumulation of dirt and other residue between the countertop and the sink rim which commonly occurs with a self-rimming or drop-in sink where the sink rim sits on the upper surface of the countertop. Undermounting also reduces leakage between the countertop and the sink.

While undermounting of sinks is commonly used with granite, solid surface, marble, etc. countertops, problems have been encountered in the undermounting of sinks on decorative laminate countertops. In particular, it is common for undermounted sinks on decorative laminate countertops to exhibit "telegraphing". That is, the flange of the sink is exposed from the upper surface of the countertop due to bowing or flexing in the decorative laminate resulting from the interaction of the sink flange as it is secured to the underside of the decorative laminate. In addition, where an uneven adhesive line is applied between the underside of the decorative laminate and the sink flange or where excessive pressure is applied between the underside of the decorative laminate and the sink flange, telegraphing (that is, exposure of the undermounted sink along the upper surface of the decorative laminate) is further compounded.

As such, an improved method for undermounting of sinks is required. The present invention provides such a method.

SUMMARY OF THE INVENTION

It is, therefore, an object of the present invention to provide a method for undermounting a sink to a countertop. The method is achieved by preparing a countertop having a backside and an upper surface, the countertop being composed of a decorative laminate secured to a substantially rigid substrate. A sink is then prepared for installation, wherein the sink includes a bowl and an outwardly extending sink flange. Thereafter a primary channel is routed within the backside of the countertop, the primary channel includes a base and is shaped and dimensioned for receipt of the sink flange, and a secondary channel is routed within a base of the primary channel along an interior circumference of the primary channel. Substrate material is then removed from the secondary channel to expose an underside of the decorative laminate and adhesive is applied within the secondary channel so that the underside of the decorative laminate is fully covered. A bead of adhesive is applied to the base of the primary channel and the sink flange is placed within the primary channel. A support plate is secured around the sink flange to provide support and a central portion of the countertop defined by the primary channel is cut out to expose the bowl of the sink.

It is also an object of the present invention to provide a method wherein the step of preparing includes ensuring a height of the sink flange is approximately ⅝-inch (15.9 mm), or less, and trimming the sink flange to a desired thickness if the height exceeds ⅝-inch (15.9 mm).

It is also another object of the present invention to provide a method wherein the step of routing the primary channel includes preparing a template substantially conforming to a sink cut out required for undermounting of the sink to the countertop and fastening the template to the backside of the countertop.

It is also a further object of the present invention to provide a method wherein the primary channel has a width of approximately 1⅞-inch (47.6 mm) to approximately 2⅛-inch (54.0 mm) and the substrate in the primary channel has a thickness of approximately 3/32-inch (2.4 mm) to approximately ⅛-inch (3.2 mm).

It is another object of the present invention to provide a method wherein the secondary channel has a width of approximately ¾-inch (19.0 mm) and the substrate in the secondary channel has a thickness of approximately 1/64-inch (0.4 mm).

It is a further object of the present invention to provide a method wherein the step of removing includes cleaning the underside of the decorative laminate.

It is also an object of the present invention to provide a method wherein the adhesive matches the sink color.

It is yet a further object of the present invention to provide a method wherein the substrate is medium density fiberboard or particleboard.

It is still another object of the present invention to provide a method wherein the decorative laminate is high pressure decorative laminate.

It is also an object of the present invention to provide an undermounted sink and countertop assembly in accordance with the combination described above.

Other objects and advantages of the present invention will become apparent from the following detailed description when viewed in conjunction with the accompanying drawings, which set forth certain embodiments of the invention.

BRIEF DESCRIPTION OF THE DRAWINGS

FIGS. 2 through 21 show the steps associated with the present method for undermounting a sink to a countertop as follows:

FIG. 2 is a perspective view showing staple strips secured to a flat sheet;

FIG. 3 is a perspective view showing the sink positioned adjacent the thick staple strips;

FIG. 4 is a cross sectional view along the line 4-4 in FIG. 3;

FIG. 5 is perspective view of a sink template;

FIG. 6 is a perspective view showing use of a router in cutting primary channel;

FIG. 7 is a cross sectional view showing the sink template and the primary channel cut in the decorative laminate countertop;

FIG. 8 is a perspective view showing cutting of a secondary channel;

FIG. 9 is a cross sectional view showing the decorative laminate countertop with the secondary channel cut therein;

FIG. 10 is a perspective view showing chiseling of the secondary channel to remove any substrate material and expose the underside of the decorative laminate;

FIG. 11 is a perspective view showing the decorative laminate countertop after the underside of the decorative laminate has been exposed;

FIG. 12 is a perspective view showing the application of adhesive within the secondary channel;

FIG. 13 is a perspective view showing the application of a bead of adhesive around the perimeter of the primary channel;

FIGS. 14 and 15 are a perspective view and cross sectional view showing the sink flange placed within the primary channel;

FIG. 16 is a top perspective view showing weights placed on the sink;

FIG. 17 is a detailed perspective view showing filling of any gaps existing between the sink flange and the substrate;

FIG. 18 is a perspective view of a support plate glued to the substrate and fastened thereto with nails or screws;

FIGS. 19 and 20 respectively show a cross sectional side view and a perspective view of the removal of the central portion of the decorative laminate countertop with a tilt-base trim router; and FIG. 21 is a perspective view showing softening of the laminate edge using a file.

DESCRIPTION OF THE PREFERRED EMBODIMENT

Figure 1:
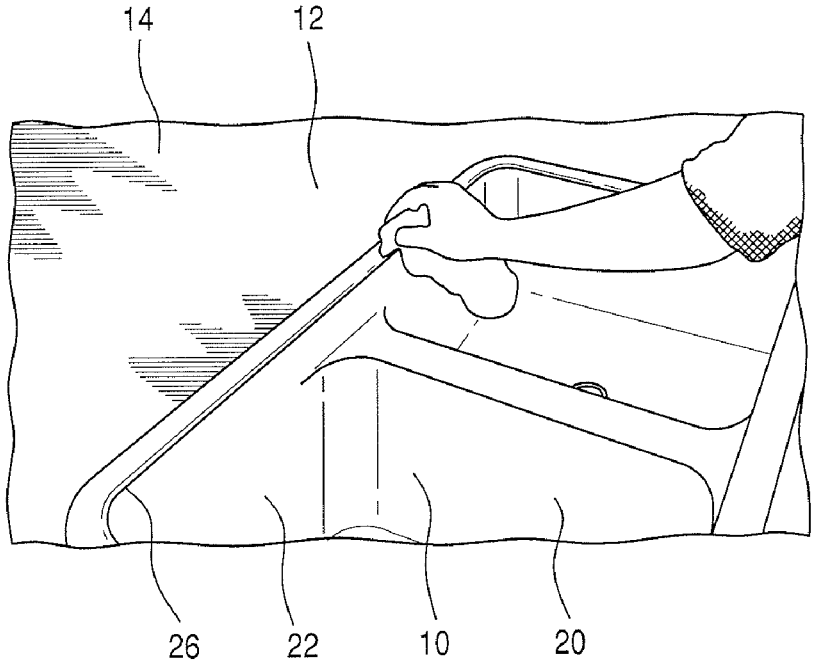
FIG. 1 is a perspective view of a sink mounted in accordance with the present invention as it is being cleaned during the final steps of the installation process.

The detailed embodiment of the present invention is disclosed herein. It should be understood, however, that the disclosed embodiment is merely exemplary of the invention, which may be embodied in various forms. Therefore, the details disclosed herein are not to be interpreted as limiting, but merely as a basis for teaching one skilled in the art how to make and/or use the invention.

In accordance with the present invention, and with reference to FIGS. 1 to 21, a method for undermounting a sink 10 to a decorative laminate countertop 12 is disclosed. As those skilled in the art will certainly appreciate, a decorative laminate countertop 12 is commonly composed of a high pressure decorative laminate 14 adhesively secured to a substantially rigid substrate 16. The high pressure decorative laminate 14 and substrate 16 are then formed to conform to a desired countertop configuration. In accordance with a preferred embodiment of the present invention, the sink is a solid surface sink, for example, WILSONART DURACRYL (a composite sink composed of a 100% acrylic surface combined with a fiber reinforced backer).

In accordance with a preferred embodiment, the substrate 16 is medium density fiberboard, although those skilled in the art will appreciate other materials, such as, but not limited to, high density fiber board, wood/plastic compositions, woods, plywood, hardboard, asbestos board, particleboard, ceramics, filled and unfilled plastics, closed-cell rigid foams, or the like, are known to be used in the construction of decorative laminate countertops and may be utilized without departing from the spirit of the present invention. Where medium density fiberboard is utilized, it will preferably have a thickness of approximately ¾-inch (19.0 mm) to approximately 1½-inch (38.1 mm).

With regard to the high pressure decorative laminate 14, those skilled in the art will appreciate that high pressure decorative laminate 14 is commonly understood to refer to a sheet material composed of a plurality of layers of synthetic resin impregnated paper sheets consolidated or bonded together into a unitary structure under heat and pressure. In normal practice, the high pressure decorative laminate assembly, from the bottom up, includes a core of one or more sheets of Kraft paper impregnated with phenolic resin, above which lies a decorative sheet of alpha-cellulose paper impregnated with melamine resin and/or an overlay impregnated with melamine resin. The decorative laminate is consolidated by placing the resin impregnated core and decorative sheets between steel coated, steel, or stainless steel plates and subjecting the laminate stack to temperatures ranging from about 150° F. (65.6° C.) to about 500° F. (260° C.) and pressures ranging from about 800 psi to about 1600 psi for a time sufficient to consolidate the laminate and cure the resins (generally about 25 minutes to an hour). This causes the resin in the paper sheets to flow, cure, and consolidate the sheets into a composite or unitary laminated mass referred to in the art as a high pressure decorative laminate (HPDL). More than one laminate can be formed at one time by inserting a plurality of assembled sheets in a stack with each assembly being separated by a release sheet which allows the individual laminates to be separated after consolidation. Finally, the decorative laminates 14 are further processed and ultimately secured to the substrate 16.

While high pressure decorative laminate 14 is disclosed for use in accordance with a preferred embodiment, those skilled in the art will appreciate other decorative surfacing materials are known in the art and may be employed without departing from the spirit of the present invention.

The present method for undermounting a sink 10 upon a decorative laminate countertop 12 reduces telegraphing by 80% when compared to current techniques. The present method also reduces scraping of the substrate 16 (to expose the underside 48 of the decorative laminate 14 as discussed below in greater detail) by over 50% and reduces the stress imposed on the decorative laminate 14 from scraping. As will be appreciated based upon the following disclosure, the present method results in the creation of an approximately ⅛-inch (3.2 mm) seam line between the sink flange 18 of the sink 10 and the decorative laminate 14. The ⅛-inch (3.2 mm) seam line is approximately ½-inch (12.7 mm), or less, in width and creates a very slight natural decrease into the bowl 20 of the sink 10.

The decorative laminate countertop 12 is first prepared and assembled for installation upon a cabinet or other support surface (not shown). This is achieved using conventional fabrication techniques well known to those skilled in the art. In addition, a sink 10 is purchased or otherwise acquired for undermounting along the decorative laminate countertop 12. As those skilled in the art will certainly appreciate, a conventional sink 10 designed for undermounting includes a central bowl 20 with an internal surface 22 and an external surface 24. The central bowl 20 includes an upper edge 26 from which an outwardly extending sink flange 18 extends. As will be appreciated based upon the following disclosure, the sink flange 18 is shaped and dimensioned for engagement with the countertop 12.

Although every effort will certainly be made to provide high quality materials, free of defects, a final inspection of the decorative laminate countertop 12 must be conducted to ensure the quality of both the decorative laminate countertop 12 and the sink 10 are up to appropriate standards. In particular, it must be verified that the height of the sink flange 18, that is, the distance from its upper surface **18*a* to its lower surface 18*b* is approximately ⅝-inch (15.9 mm), or less, in thickness. As will be appreciated based upon the following disclosure, it is important the height of the sink flange 18 be approximately ⅝-inch (15.9 mm), or less, in order to ensure a secure mounting of the sink 10 to the backside 28 of the decorative laminate countertop 12. If the thickness of the height of the sink flange 18 is not approximately ⅝-inch (15.9 mm), or less, a flange template 30 is manufactured to facilitate proper trimming of the sink flange 18. As will be appreciated based upon the following disclosure of the method in accordance with the present invention, the height of the sink flange 18 is important in ensuring that the sink flange 18 is properly mounted within the primary channel 38 such that it does not extend beyond the backside 28 of the decorative laminate countertop 12**.

Figure 2:
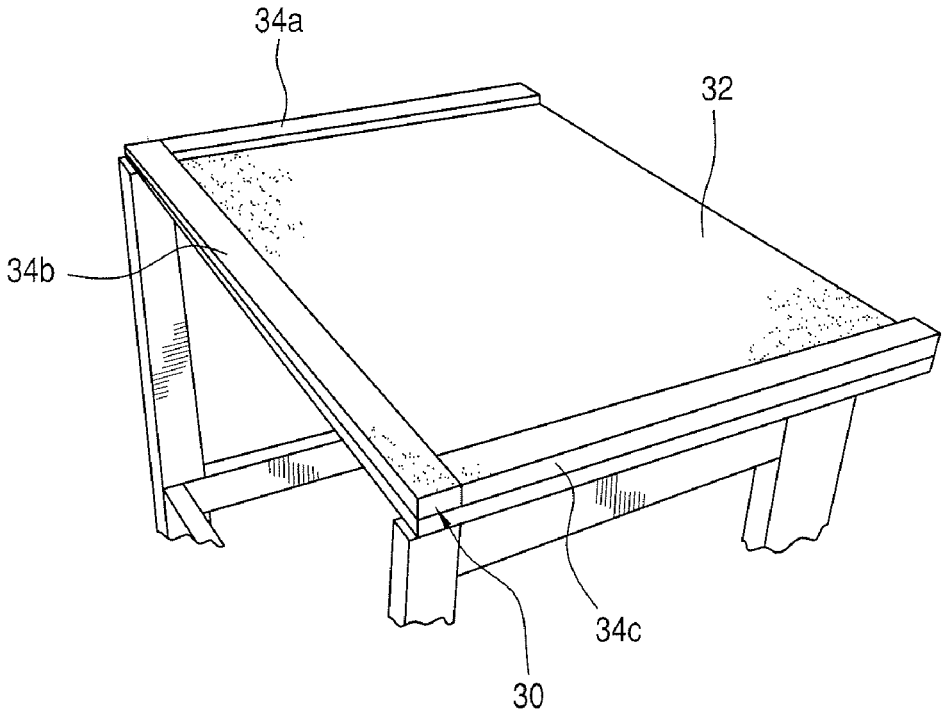
Figure 3:
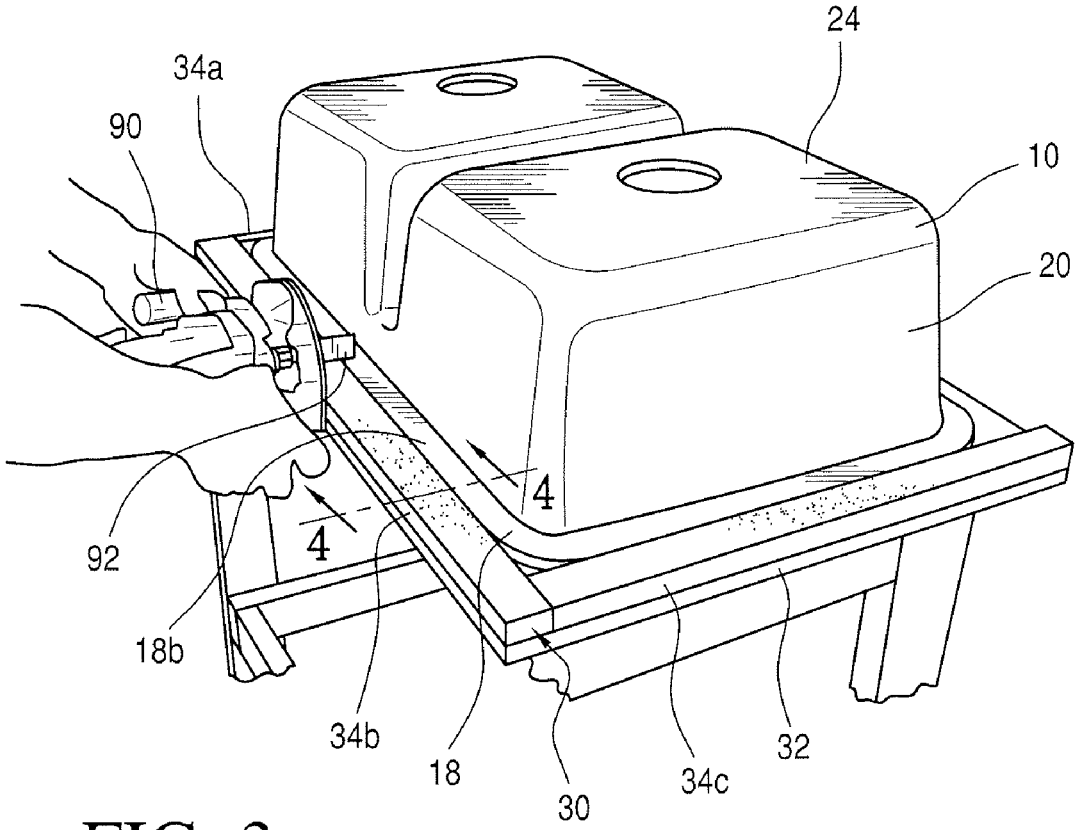
Figure 4:
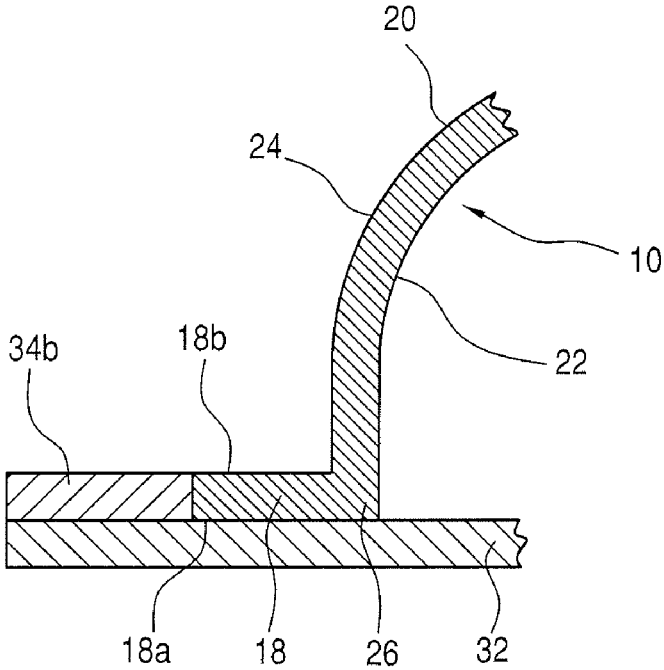

In accordance with a preferred embodiment, and with reference to FIGS. 2, 3 and 4 the flange template 30 is composed of one flat sheet 32 of approximately ¾-inch (19.0 mm) thickness particleboard and three staple strips 34*a*, 34*b*, 34*c* of ⅝-inch (15.9 mm) thickness particleboard trimmed to approximately a 1½-inches (38.1 mm) width. The staple strips 34*a*, 34*b*, 34*c* are secured to the flat sheet 32 and the flange 18 of the sink 10 is positioned adjacent the ⅝-inch (15.9 mm) thick staple strips 34*a*, 34*b* (see FIGS. 3 and 4). At this point, excess material is removed from the sink flange 18 preferably using a router 90 and a top bearing flush trim bit 92.

Figure 5:
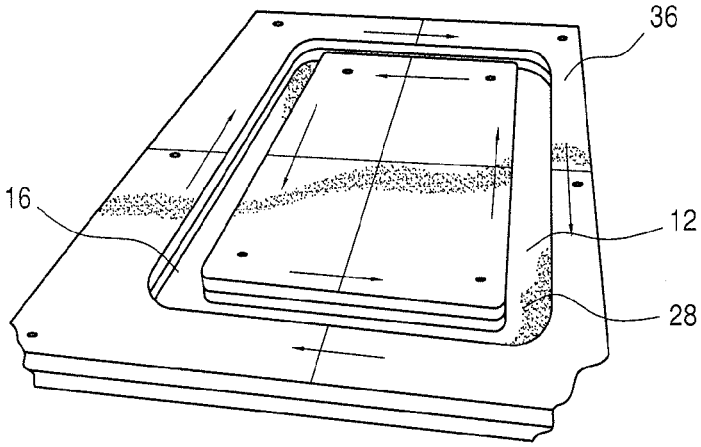
Figure 6:
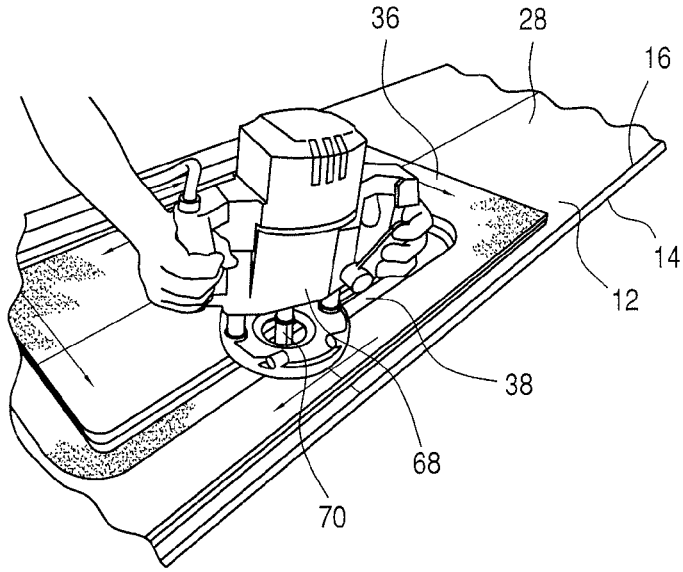
Figure 7:
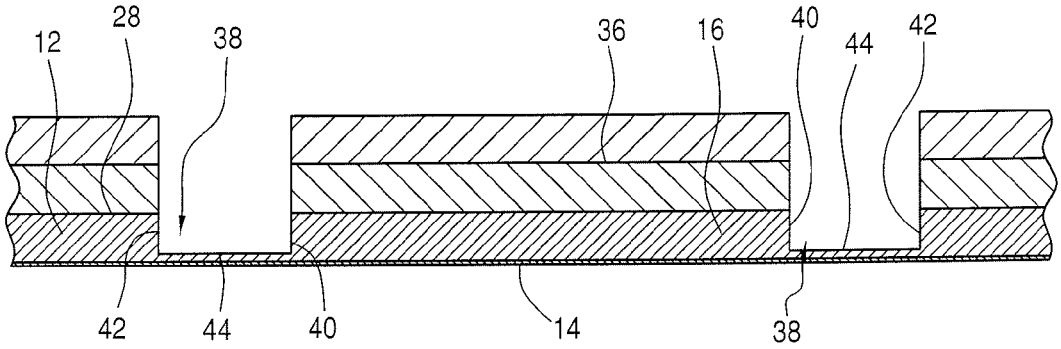

Next, the decorative laminate countertop 12 must be prepared for application of the sink 10 thereto. Referring to FIGS. 5, 6 and 7, a sink template 36 of the cut out required for positioning of the sink 10 upon the countertop 12 is first prepared. Those skilled in the art will appreciate that the cut out, and ultimately the sink template 36, should follow the dimensions of the sink 10 so as to define an opening in the decorative laminate countertop 12 which is in alignment with the bowl 20 of the sink 10. Most sinks will be provided with instructions for template construction. Once the sink template 36 is prepared, it is fastened on the backside 28 of the countertop 12 where one desires the sink 10 to be installed.

Referring to FIGS. 6 and 7, using a router 68 with an approximately 1-inch to approximately 1⅛-inches (28.6 mm) wide top bearing flush trim bit 70, a primary channel 38 is cut into the backside 28 of the decorative laminate countertop 12, in particular, the medium density fiberboard substrate 16 of the decorative laminate countertop 12. In accordance with a preferred embodiment, the primary channel 38 has a width of approximately 1⅞-inches (47.6 mm) to approximately 2⅛-inches (54.0 mm). The primary channel 38 is cut such that the final thickness of the medium density fiberboard substrate 16 in the area of the primary channel 38 is approximately 3/32-inch (2.4 mm) to approximately ⅛-inch (3.2 mm). This is achieved by setting the bit depth to a depth of approximately 3/32-inch (2.4 mm) to approximately ⅛-inch (3.2 mm) less than the thickness of the medium density fiberboard substrate 16 and the sink template 36. The resulting primary channel 38 includes an interior sidewall 40 defining the interior circumference of the primary channel 38, an exterior sidewall 42 defining the exterior circumference of the primary channel 38, and a base 44.

Figure 8:
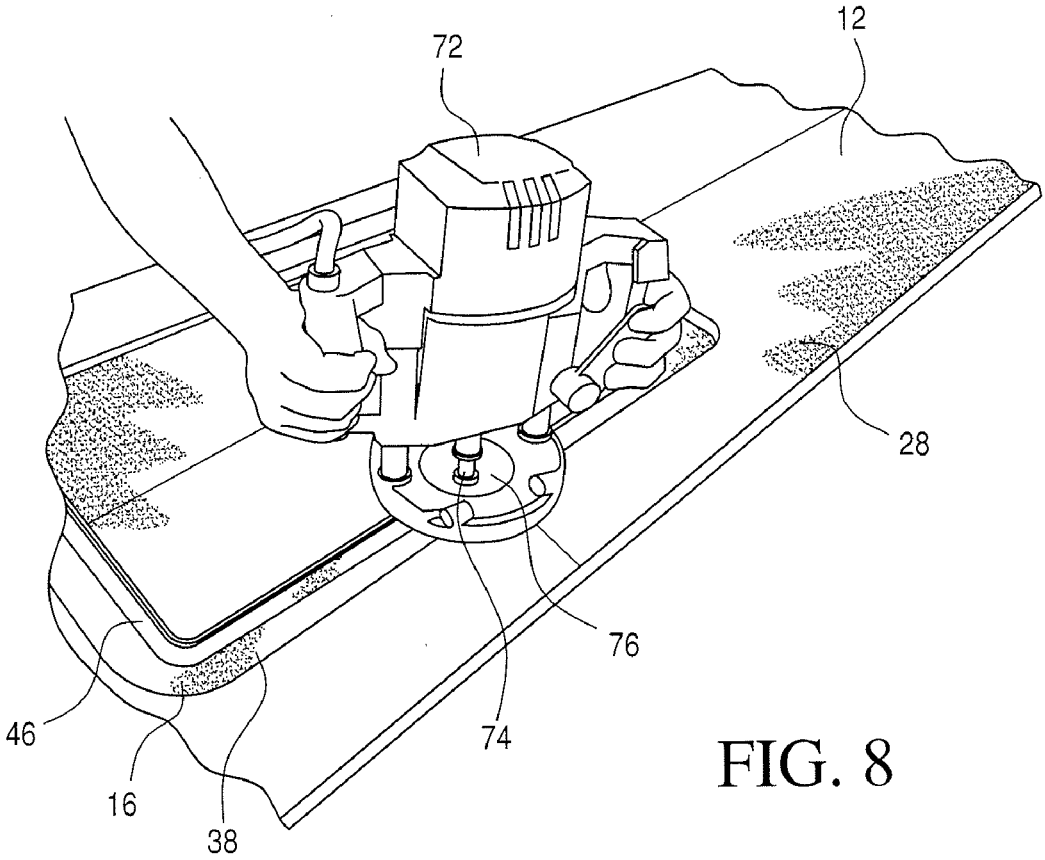
Figure 9:
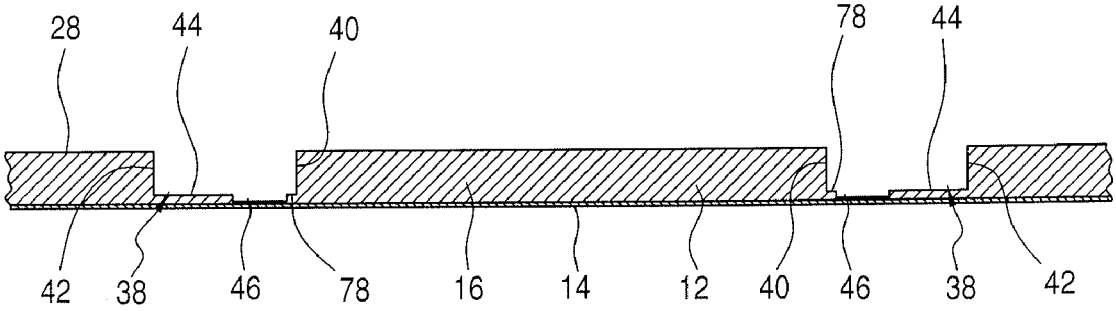

At this point, the sink template 36 is removed from the decorative laminate countertop substrate 16 and a secondary channel 46 is cut. Referring to FIGS. 8 and 9, using a router 72 with a ¾-inch (19.0 mm) wide straight cut bit 74 and a 1¼-inch (31.75 mm) template guide 76, a secondary channel 46 is routed along the interior circumference of the primary channel 38 forming another channel in the base 44 of the primary channel 38. The secondary channel 46 is formed along the interior circumference of the primary channel 38 such that a small edge section 78 of the ⅛-inch portion of the substrate 16 remains directly adjacent the interior sidewall 40. The small edge section 78 is ultimately cut out when the sink opening is cut out as discussed below in greater detail. The secondary channel 46 is approximately ¾-inch (19.0 mm) wide and is cut such that the medium density fiberboard substrate 16 in the area of the secondary channel 46 has a thickness of approximately 1/64-inch (0.4 mm). It should be noted that one should be careful not to remove all of the substrate 16 to reveal the decorative laminate 14 due to variations in the substrate 16. In particular, if one cuts too deep, the decorative laminate 14 will be contacted by the bit and will likely be changed.

Figure 10:
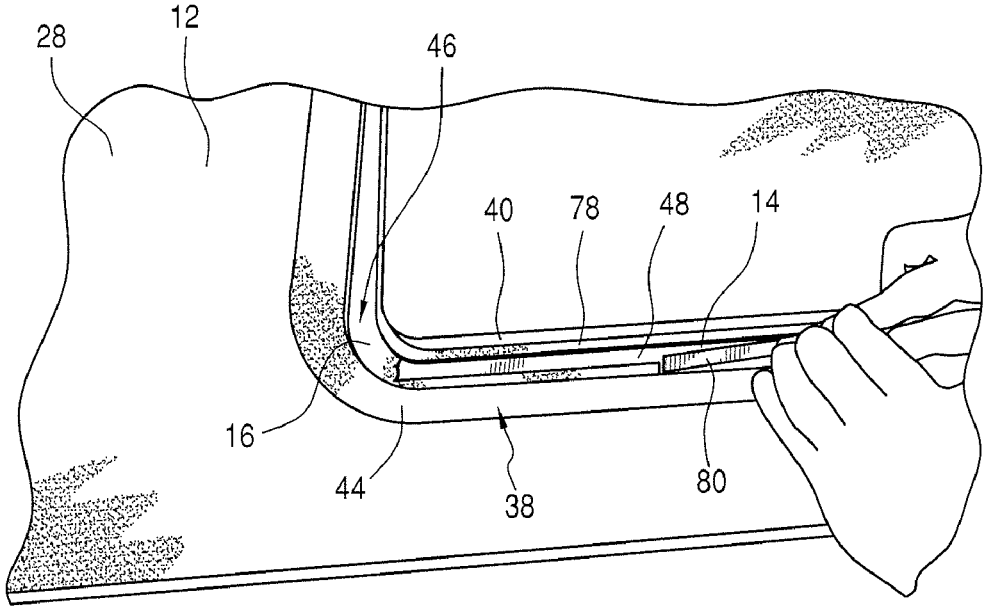
Figure 11:
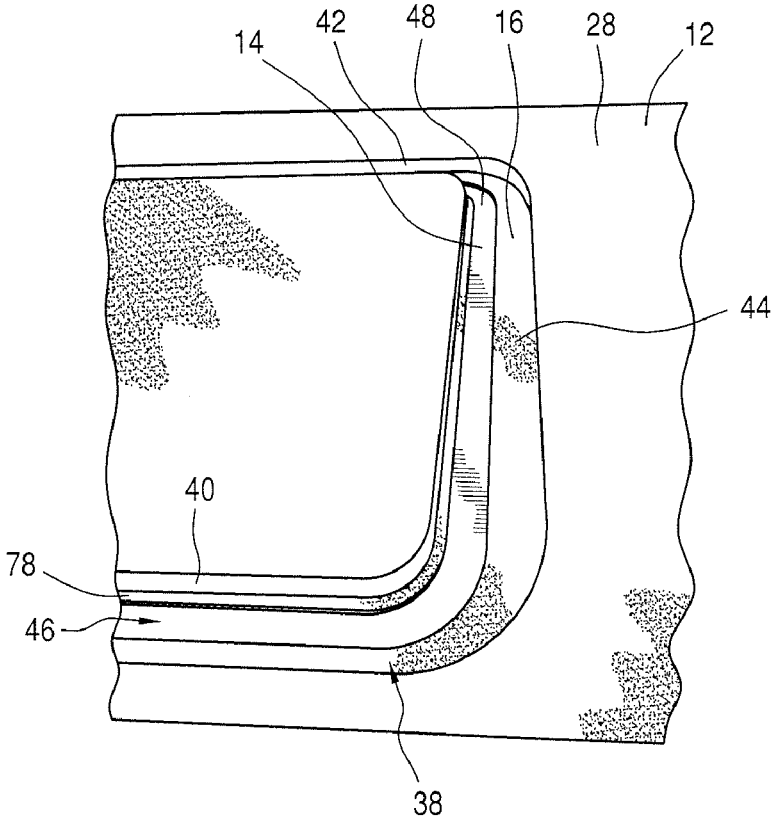

At this point, and with reference to FIGS. 10 and 11, the secondary channel 46 is chiseled to remove any substrate 16 material and expose the underside 48 of the decorative laminate 14. This is achieved by utilizing a sharp chisel 80 to scrape the substrate 16 material from the secondary channel 46. It should be noted that the chisel 80 should remain level while scraping so as not to damage to the underside 48 of the decorative laminate 14. Once the substrate 16 material is fully removed from the secondary channel 46, a wire brush is utilized to clean the exposed underside 48 of the decorative laminate 14. Thereafter, the underside 48 of the decorative laminate 14 is cleaned with compressed air.

As will be appreciated based upon the following disclosure, the creation of the secondary channel 46 in combination with the primary channel 38 results in a reduction in the amount of decorative laminate 14 that is exposed to adhesive and the flange 18. In addition, and as will be appreciated with the following discussion regarding attachment of the sink 10, neither the bowl 20 nor flange 18 of the sink 10 ever touches the decorative laminate 14, which decreases telegraphing.

Figure 12:
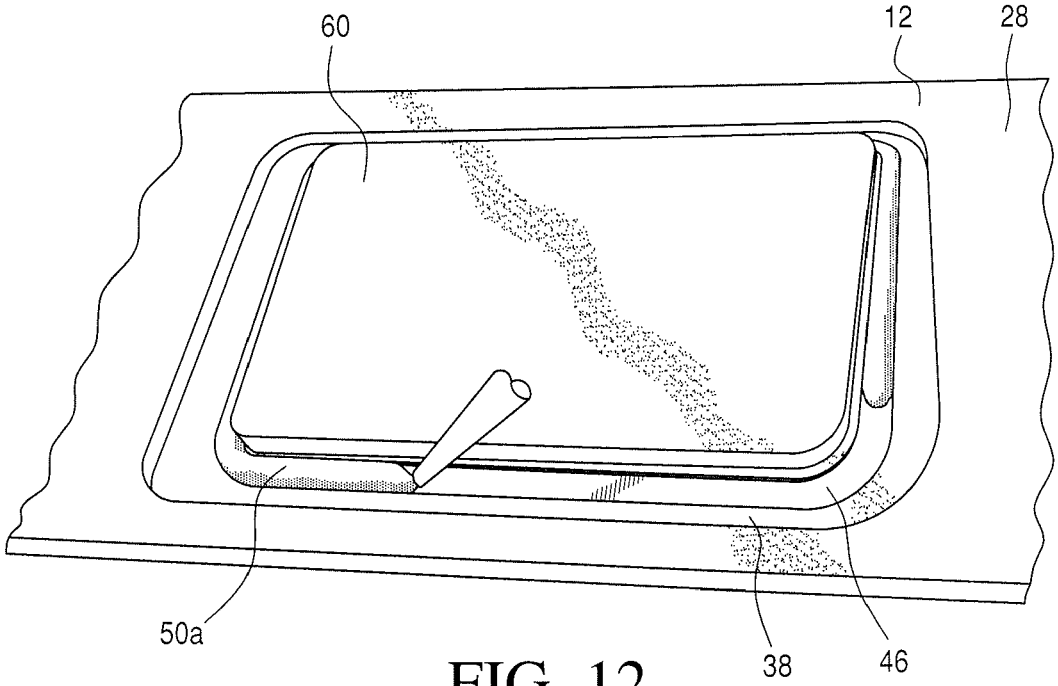
Figure 13:
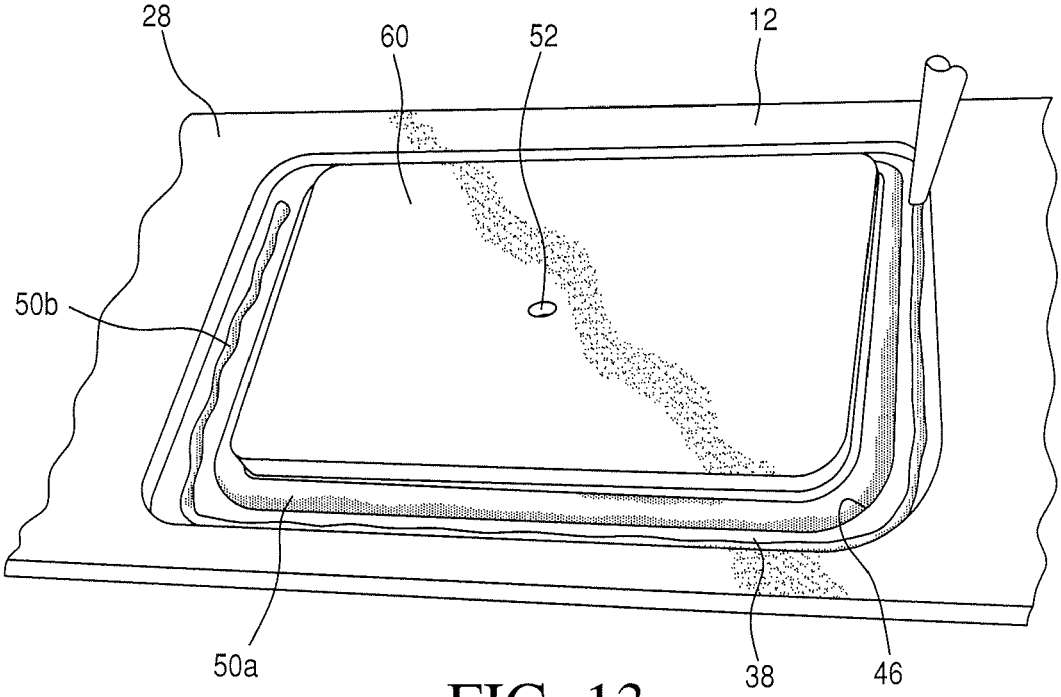

Referring to FIGS. 12 to 21, the sink 10 is now secured to the decorative laminate countertop 12 in the area defined by the primary and secondary channels 38, 46. Referring to FIG. 12, a solid surface seam adhesive is prepared. The adhesive is prepared such that it substantially matches the color of the sink 10. After the solid surface seam adhesive is prepared (and the tube in which it is prepared is purged to ensure proper mixture with the catalyst), adhesive 50*a* is applied within the secondary channel 46 such that the secondary channel 46 is filled with adhesive 50*a* so that no decorative laminate 14 is visible. In addition, and with reference to FIG. 13, approximately a ¼-inch (6.4 mm) bead of adhesive 50*b* is applied to the exposed substrate the base 44 around the perimeter of the primary channel 38. A pilot hole 52 is drilled in the center of the decorative laminate countertop 12 in the center portion 60 defined by the primary channel 38. The sink flange 18 is then cleaned with denatured alcohol. For stubborn residue, the sink flange may be cleaned with denatured alcohol and a Scotch-Brite®, abrasive, pad.

Figure 14:
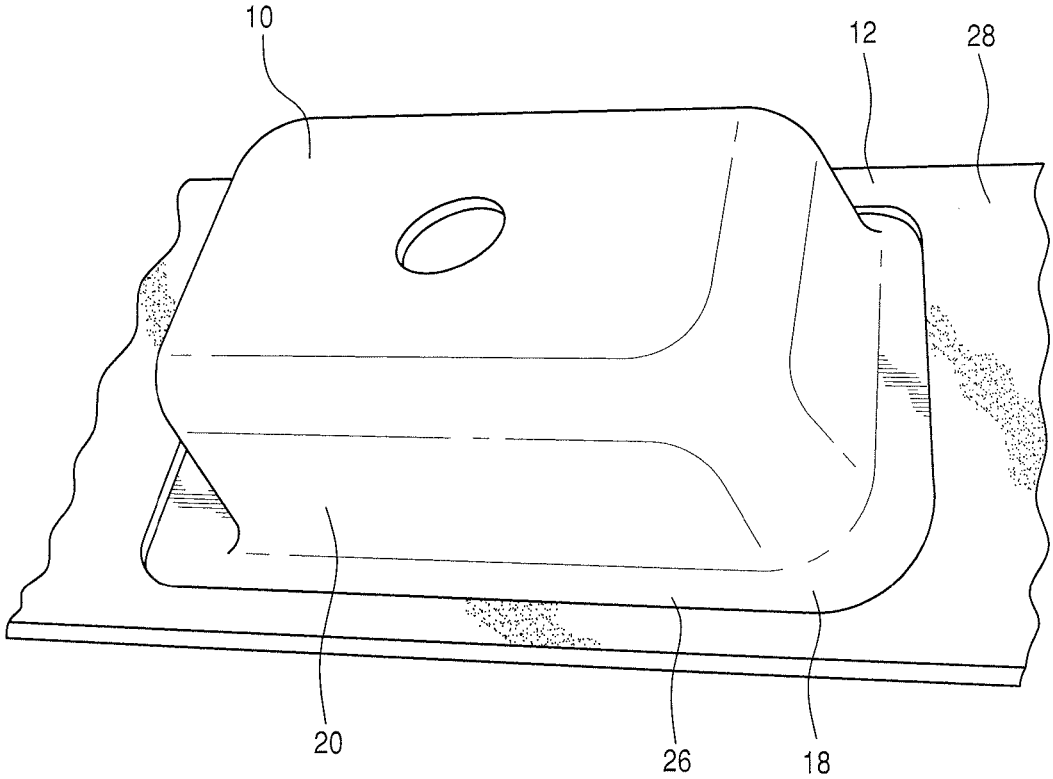
Figure 15:
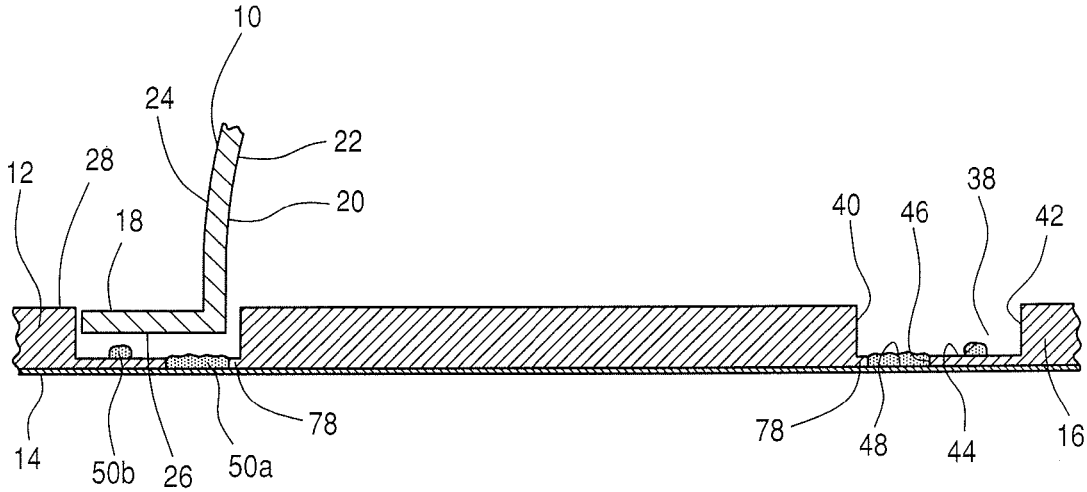
Figure 19:
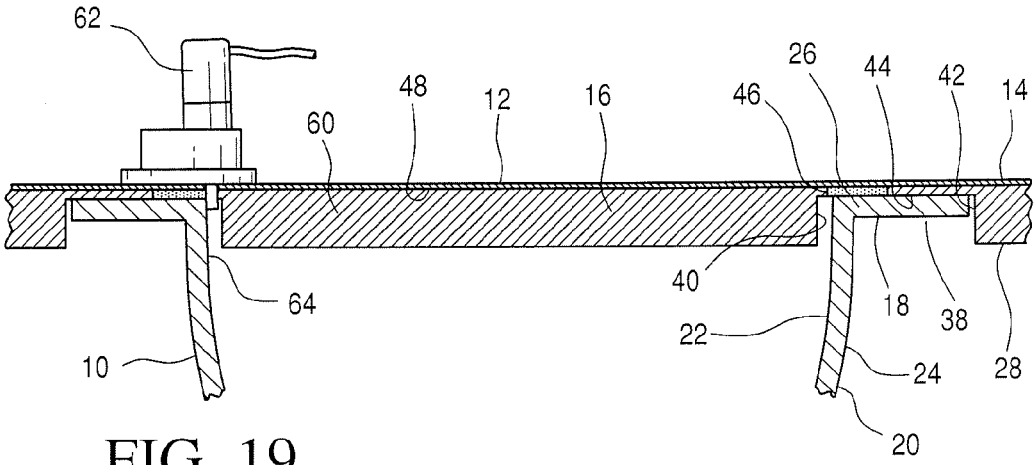
Figure 20:
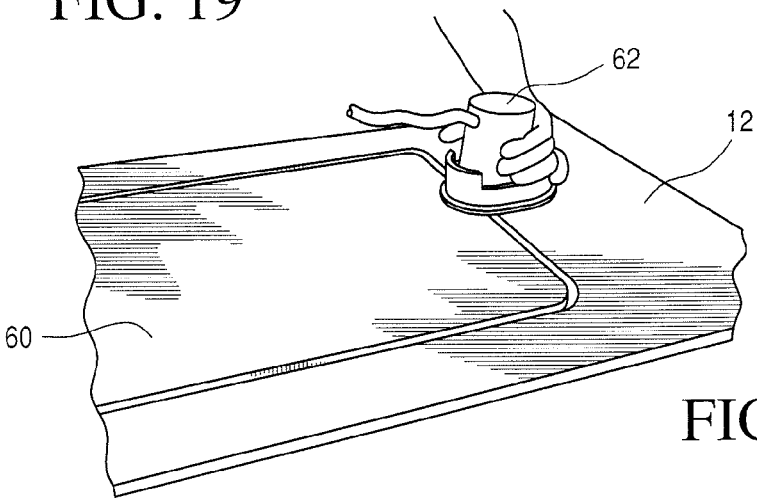
Figure 21:
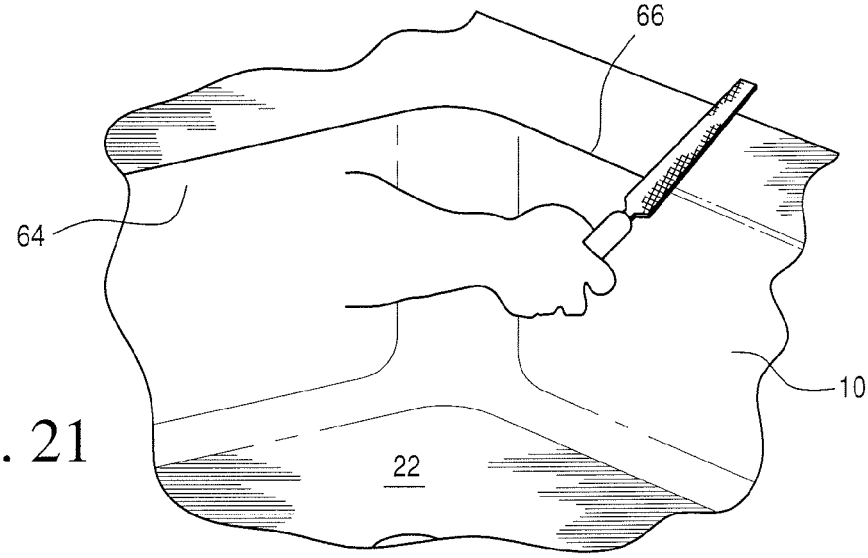

Thereafter, and with reference to FIGS. 14 and 15 (with only the left side of the sink 10 shown), the sink 10 is inverted with the bowl 20 facing downwardly and the sink flange 18 is placed within the primary channel 38 with at least a portion of the sink flange 18 supported by the base 44 of the primary channel 38. The sink 10 is moved slightly to spread the seam adhesive 50*a*, 50*b*. The center of the sink 10 is then properly positioned by aligning registered marks on the sink flange 18 with center marks on the substrate 16. As those skilled in the art will appreciate, the sink center registration marks upon the sink flange 18 are provided by the sink manufacture and, ultimately, verified by the fabricator.

Thereafter, and with reference to FIG. 16, weights 54 are placed on the sink 10 (for example, twenty pounds per drain hole). Although the utilization of weights is desired in accordance with a preferred embodiment, some may determine that it is unnecessary to utilize the weights for complete curing of the sink 10 to the decorative laminate countertop 12.

Thereafter, any gaps existing between the sink flange 18 and the substrate 16 (in particular, between the flange 18 and the exterior sidewall 42 of the primary channel 38) are filled with silicone 56 (see FIG. 17). An approximately ¾-inch (19.0 mm) thick wood support plate 58 (which may be composed of multiple pieces or a single piece of material) is then secured to the substrate 16 in a manner covering the flange 18 of the sink 10 to provide support. The support plate 58 should only cover the area of the flange 18 that was trimmed at the beginning of this process and extend approximately 2 inches over the substrate 16 not cut away. The support plate 58 is glued to the substrate 16 and fastened thereto with nails or screws (see FIG. 18). The wood support plates should not be placed where faucet holes will ultimately be drilled.

Once the flange 18 of the sink 10 is fully secured to the backside 28 of the decorative laminate countertop 12, the central portion 60 of the decorative laminate countertop 12 defined by the primary channel 38 may be removed to expose the bowl 20 of the sink 10. In particular, and with reference to FIGS. 19 and 20, this is achieved by utilizing a tilt-base trim router 62 with an approximately ¼-inch (6.4 mm) double-fluted bottom bearing flush trim bit. The angle of the tilt-base trim router 62 is set at approximately 1° to 2° more than the angle of the bowl wall 64 of the sink 10. The router 62 is then run around the sink 10, remembering to rotate the router base as you trim through corners such that the angle of the router corresponds with the angle of the bowl wall 64. A standard router with a bevel bit with a bottom bearing set at the correct height may also be used for trimming. Once the central portion 60 of the decorative laminate countertop 12 is removed, the edges of the decorative laminate 14 and bowl wall 64 may be sanded with a palm sander using 150 to 220 grit sandpaper. The bowl wall 64 is then buffed using Scotch-Brite® abrasive pads and the laminate edge 66 may be softened using a file (see FIG. 21). Once the bowl 20 of the sink 10 is fully processed and ready for use, the decorative laminate countertop 12 may be installed upon the cabinet, or other support structure as desired.

While the preferred embodiments have been shown and described, it will be understood that there is no intent to limit the invention by such disclosure, but rather, is intended to cover all modifications and alternate constructions falling within the spirit and scope of the invention.

The invention claimed is:

1. A method for undermounting a sink to a countertop, comprising the following steps:

preparing a countertop including a backside and an upper surface, the countertop being composed of a decorative laminate secured to a substantially rigid substrate;

preparing a sink for installation, the sink including a bowl and an outwardly extending sink flange;

routing a primary channel within the backside of the countertop, the primary channel including a base and being shaped and dimensioned for receipt of the sink flange;

routing a secondary channel within the base of the primary channel along an interior circumference of the primary channel;

removing substrate material from the secondary channel to expose an underside of the decorative laminate;

applying adhesive within the secondary channel so that the underside of the decorative laminate is fully covered;

applying a bead of adhesive to the base of the primary channel;

placing the sink flange within the primary channel;

securing a support plate around the sink flange to provide support; and cutting out a central portion of the countertop defined by the primary channel to expose the bowl of the sink.

2. The method according to claim 1, wherein the step of preparing includes ensuring a height of the sink flange is approximately ⅝-inch, or less, and trimming the sink flange to a desired thickness if the height exceeds ⅝-inch.

3. The method according to claim 1, wherein the step of routing the primary channel includes preparing a template substantially conforming to a sink cut out required for undermounting of the sink to the countertop and fastening the template to the backside of the countertop.

4. The method according to claim 1, wherein the primary channel has a width of approximately 1⅞-inch to approximately 2⅛-inch and the substrate in the primary channel has a thickness of approximately 3/32-inch to approximately ⅛-inch.

5. The method according to claim 1, wherein the secondary channel has a width of approximately ¾-inch and the substrate in the secondary channel has a thickness of approximately 1/64-inch.

6. The method according to claim 1, wherein the step of removing includes cleaning the underside of the decorative laminate.

7. The method according to claim 1, wherein the adhesive matches the sink color.

8. The method according to claim 1, wherein the substrate is medium density fiberboard or particleboard.

9. The method according to claim 1, wherein the decorative laminate is high pressure decorative laminate.

10. An undermounted sink and countertop assembly, manufactured in accordance with the method comprising:

preparing a countertop including a backside and an upper surface, the countertop being composed of a decorative laminate secured to a substantially rigid substrate;

preparing a sink for installation, the sink including a bowl and an outwardly extending sink flange;

routing a primary channel within the backside of the countertop, the primary channel including a base and being shaped and dimensioned for receipt of the sink flange;

routing a secondary channel within the base of the primary channel along an interior circumference of the primary channel;

removing substrate material from the secondary channel to expose an underside of the decorative laminate;

applying adhesive within the secondary channel so that the underside of the decorative laminate is fully covered;

applying a bead of adhesive to the base of the primary channel;

placing the sink flange within the primary channel;

securing a support plate around the sink flange to provide support; and cutting out a central portion of the countertop defined by the primary channel to expose the bowl of the sink.

11. The method according to claim 10, wherein the step of preparing includes ensuring a height of the sink flange is approximately ⅝-inch, or less, and trimming the sink flange to a desired thickness if the height exceeds ⅝-inch.

12. The method according to claim 10, wherein the step of routing the primary channel includes preparing a template substantially conforming to a sink cut out required for undermounting of the sink to the countertop and fastening the template to the backside of the countertop.

13. The method according to claim 10, wherein the primary channel has a width of approximately 1⅞-inch to approximately 2⅛-inch and the substrate in the primary channel has a thickness of approximately 3/32-inch to approximately ⅛-inch.

14. The method according to claim 10, wherein the secondary channel has a width of approximately ¾-inch and the substrate in the secondary channel has a thickness of approximately 1/64-inch.

15. The method according to claim 10, wherein the step of removing includes cleaning the underside of the decorative laminate.

16. The method according to claim 10, wherein the adhesive matches the sink color.

17. The method according to claim 10, wherein the substrate is medium density fiberboard or particleboard.

18. The method according to claim 10, wherein the decorative laminate is high pressure decorative laminate.

* * * * *